United States Patent [19]

Matsumoto et al.

[11] Patent Number: 4,970,495

[45] Date of Patent: Nov. 13, 1990

[54] RESONANT FREQUENCY CHARACTERISTIC TAG AND METHOD OF MANUFACTURING THE SAME

[75] Inventors: Takeshi Matsumoto, Yokohama; Shinya Uchibori, Horishima, both of Japan

[73] Assignee: Tokai Metals Co., Ltd., Kanagawa, Japan

[21] Appl. No.: 269,013

[22] Filed: Nov. 9, 1988

[30] Foreign Application Priority Data

Nov. 14, 1987 [JP] Japan ..... 62-288240

[51] Int. Cl.[5] ..... G08B 13/14

[52] U.S. Cl. ..... 340/568; 340/572

[58] Field of Search ..... 340/568, 572; 156/92, 156/148, 253

[56] References Cited

U.S. PATENT DOCUMENTS 3,913,219 10/1975 Lichtblau ..... 29/592
4,498,076 2/1985 Lichtblau ..... 340/572
4,567,473 1/1986 Lichtblau ..... 340/572

*Primary Examiner*—Donald O. Woodiel
*Assistant Examiner*—Geoff Sutcliffe
*Attorney, Agent, or Firm*—Oliff & Berridge

[57] ABSTRACT

A resonant frequency characteristic tag is disclosed, which comprises an electrically insulating thin film having an electric characteristic, an electric circuit consisting of a metal foil formed on one side surface of the thin film and having a predetermined length and having opposite end portions respectively formed with a capacitor section and a terminal section, the capacitor section having a piercedly formed hole extending from the side of the metal foil to the other side surface of the thin film, the metal foil being deformed in the formation of the hole into a burr-like portion extending toward the other side surface of the thin film, and an electrode metal foil formed on the other side surface of the thin film and having a size capable of containing the hole, the electrode metal foil being laminated to the other side surface of the thin film with an electrically insulating adhesive having a dielectric characteristic such that the free end of the burr-like portion and the electrode metal foil is spaced apart a predetermined distance, the terminal section of the electric circuit being electrically connected to the electrode metal foil to form a resonant circuit; and a method for manufacturing the resonant frequency characteristic tag is also disclosed.

3 Claims, 1 Drawing Sheet

RESONANT FREQUENCY CHARACTERISTIC TAG AND METHOD OF MANUFACTURING THE SAME

BACKGROUND OF THE INVENTION

1. Field of the Invention

The present invention relates to a resonant frequency characteristic tag, which is readily capable of dielectric breakdown of an electrically insulating thin film of dielectric in a high output electric field to short-circuit electrodes on the opposite sides of the dielectric to destroy a preliminarily provided resonant frequency characteristic, and a method of manufacturing the same.

2. Description of the Prior Art

In department stores, supermarkets and general retail shops, various commodity projection means are adopted in order to safeguard commodities against shop-lifting or like theft. Where an electric sensor is used, the commodities are provided with tags each having a resonant frequency circuit in order that the presence of commodity in a control area can be confirmed electronically. More specifically, when a tag is present in an area covered by the sensor and is resonant to a waveform at a certain frequency transmitted from the sensor, the sensor generates a certain alarm sound. Further, in order that such a resonant frequency characteristic tag does not generate any alarm sound in spite of its presence in the coverage area after the purchase of the pertinent commodity has been confirmed, the tag is constructed such that by application of a high output electric field to it a dielectric in its capacitor section is destroyed to short-circuit its capacitor electrodes to each other, thus destroying its resonant frequency characteristic.

The capacitor section of such a tag is fabricated by using a tool in such a manner that its constituent material is squeezed mechanically in the thickness direction to a very thin form so that application of a high output electric field to it will cause electric breakdown of its dielectric thin layer to short-circuit its electrodes to each other.

In order to be able to supply as inexpensive resonant frequency characteristic tags as possible to the marker, the cost of manufacture should be as low as possible. In the aspect of electric characteristics, to obtain a resonant characteristic necessary to the resonant frequency circuit, the material of the tag should be such that it is possible to obtain the intended size and allowance very accurately. To meet such theoretical requirement, a substrate which is used in the prior art tag for providing the resonant frequency is fabricated by applying an aluminum foil having a thickness ranging from 0.05 to 0.009 mm to each side surface of a polyethylene film having a thickness of 0.025 mm and with a thickness allowance of ±5%. The aluminum foil is applied by an extrusion process in case of low density polyethylene. In case of high density polyethylene, a thermal press process is used for the application. However, with the substrate that is prepared in the above ways, it is difficult to attain the aim of the invention, i.e., to cause dielectric breakdown of the electrically insulating thin film to short-circuit the two electrodes to each other.

In the method of mechanically squeezing the tag material using a tool, it is difficult to control the working conditions such as to obtain the thickness to a range less than 0.002 mm, in which the dielectric breakdown of the dielectric is possible, due to such causes as thickness fluctuations of the material and difference in working ranges in manufacture. Therefore, it is liable that the dielectric is completely ruptured during the manufacture so that short-circuit of the electrodes can no longer be obtained, or if the urging pressure or like working condition is insufficient, the resultant dielectric film has a thickness too large to cause the dielectric breakdown.

SUMMARY OF THE INVENTION

An object of the invention is to provide a resonant frequency characteristic tag, which is reliably and readily capable of dielectric breakdown of the dielectric and short-circuit of the electrodes.

Another object of the invention is to provide a method, which permits ready manufacture of the resonant frequency characteristic tag reliably and readily capable of dielectric breakdown cf the dielectric and short-circuiting of the electrodes.

According to the present invention, there is provided a resonant frequency characteristic tag, which comprises an electrically insulating thin film having an electric characteristic, an electric circuit consisting of a metal foil formed on one side surface of the thin film and having a predetermined length and having opposite end portions respectively formed with a capacitor section and a terminal section the capacitor section having a piercedly formed hole extending from the side of the metal foil to the other side surface of the thin film, the metal foil being deformed in the formation of the hole into burr-like portion extending toward the other side surface of the thin film, and an electrode metal foil formed on the other side surface of the thin film and having a size capable of containing the hole, the electrode metal foil being applied to the other side surface of the thin film with an electrically insulating adhesive having a dielectric characteristic such that the free end of the burr-like portion and the electrode metal foil is spaced apart a predetermined distance, the terminal section of the electric circuit being electrically connected to the electrode metal foil to form a resonant circuit.

DETAILED DESCRIPTION OF THE INVENTION

Figure 1:
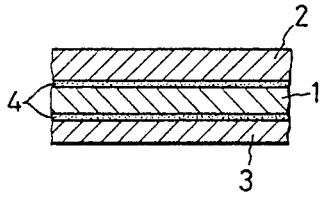
FIGS. 1 to 6 are views for explaining the method of manufacturing a resonant frequency characteristic tag according to the present invention, the individual figures being schematic sectional views showing respective steps.

The resonant frequency characteristic rag according to the present invention can be obtained by a method, which comprises:

a step of forming an electric circuit consisting of a metal foil, having a predetermined length and having an end portion with a capacitor section and terminating section on one side surface of an electrically insulating thin film having a dielectric characteristic;

a step of forming the capacitor section with a hole by piercing the capacitor section from the side of the metal foil toward the other side surface of the thin film to thereby deform the metal foil such as to form a burr-like portion extending toward the other side surface of the thin film;

a step of laminating an electrode metal foil having a size capable of containing the hole to the other side surface of the thin film with an electrically insulating adhesive having a dielectric characteristic such that the free end of the burr-like portion and the electrode metal foil are spaced apart a predetermined distance; and a step of forming a resonant circuit by electrically connecting the terminal section of the electric circuit and the electrode metal foil to each other.

More specifically, according to the present invention, there is provided a method, which comprises steps of forming an electric circuit substrate by laminating a metal foil to each side surface of an electrically insulating thin film having a dielectric characteristic by such bonding process as a dry lamination process or a thermal press process by using an adhesive having a dielectric characteristic and having a dielectric tangent value equal to or smaller than that of the thin film, printing an electric circuit on the metal foil on one side surface of the electric circuit substrate with an etching resist ink, chemically etching the resultant system to form a resonant circuit and also entirely remove the non-printed metal foil on the other side surface of the thin film, subsequently forming at least one through hole in a capacitor section of the electric circuit by piercing the capacitor section in the thickness direction thereof from the side of the metal foil by using a needle or the like, pressure-bonding an adhesive-coated electrode metal foil having a size greater than the area of the through hole and sufficient to form a resonant circuit using a heated die or the like such as to conceal the opening of the through hole on the side opposite the metal foil of the capacitor section of the electric circuit, short-circuiting a coil terminal section of the electric circuit and an end portion of the electrode metal foil corresponding to a capacitor electrode to each other by means of urging to form the resonant circuit, subsequently laminating a printed or non-printed paper sheet or the like to the side of the electric circuit and also a release paper sheet or the like to the opposite electrode metal foil side by an adhesive, a pressure sensitive adhesive or the like, and stamping-out or semi-stamping the resultant lamination with a die to a desired tag size, thus obtaining a resonant frequency characteristic tag.

According to the present invention, the metal foils used preferably are each a member of a group consisting of a copper foil, an aluminum foil and an iron foil, these foils being in a coil-like form and capable of being laminated continuously and also being etched and having a thickness ranging from 6 to 50 microns.

Aluminum foils are particularly preferred in view of the cost, process ability and electric properties. Usually, aluminum foils with purities ranging from 99.0 to 99.9% are used.

The electrically insulating thin film having a dielectric characteristic is usually a synthetic resin film having a thickness ranging from 4 to 10 microns and made from a member of a group consisting polyethylene, polypropylene, polystyrene and polyester. According to the present invention, these plastic films are by no means limitative, and it is possible to use resin-impregnated paper sheets as well.

The adhesive which is used for laminating the metal foils suitably has a dielectric characteristic as a dielectric and also has a dielectric tangent value equal to or smaller than that of the electrically insulating thin film. As an example, an adhesive consisting of polyethylene, polypropylene, polystyrene or polyester may be used. Preferably, the same material as that of the thin film is used.

The needle used for forming the through hole is not particularly limited, but it is preferred to use a needle having a diameter in a range of 0.08 to 0.10 mm and a tip diameter in a range of 0.03 to 0.06 mm. It is suitable to provide a plurality of through holes although a single through hole suffices. The burr-like portion formed with the formation of the through hole suitably has its free end found in the back side surface of the thin film. In some case, the burr-like portion may be confined in the through hole.

The resin coating on one side surface of the electrode metal plate suitably has a thickness in a range of 0.0001 to 0.0003 mm and of the same resin as the dielectric.

While a paper sheet or the like is laminated as support to the metal foil such as an aluminum foil forming the capacitor, the adhesive used for the lamination advantageously is non-heat-resistant and provides a bonding strength after the lamination of 50 to 100 g/cm$^2$ for the subsequent processing.

The very thin dielectric film formed between the burr-like portion of the metal foil formed with the formation of the through hole using a needle or the like and the metal foil pressbonded to conceal the through hole for the formation of the capacitor suitably has a thickness in a range of 0.0001 to 0.0002 mm in view of the capability of destruction of the resonant frequency circuit.

According to the present invention, the substrate is prepared by laminating an electric circuit metal foil and an electrode metal foil to the respective opposite side surfaces of an electrically insulating thin film having a fixed thickness as thin as possible. The various components of the substrate are required to have the following physical properties.

The metal foils used should meet necessary electric characteristics, have capability of lamination and etching and conform to the physical properties of the commodity, to which the tag is provided.

The electrically insulating thin film should be well capable of processing in a coil-like form. It is suitably as thin as possible if a resonant frequency characteristic can be obtained. Its thickness should be uniform, and also its dielectric loss tangent and dielectric breakdown voltage should be small.

From the above, the thin film is suitably a polypropylene or like film having a thickness in a range of 0.004 to 0.010 mm.

The present invention will now be described in conjunction with an example, which is by no means limitative.

EXAMPLE

As shown in FIG. 1, an electric circuit substrate was formed by laminating an electric circuit aluminum foil 2 and a protective aluminum foil 3 to a polypropylene thin film 1 with adhesive 4.

The bonding property of the aluminum foil and polypropylene is not satisfactory. Therefore, it is impossible to apply aluminum foils to both side surfaces simultaneously by an extrusion process which requires a low processing cost. For this reason, either a dry lamination process using an adhesive or a thermal press process is adopted as the bonding process. The adhesive 4 used should have a dielectric property and its dielectric tangent value should be equal to or smaller than that of the electrically insulating thin film. Therefore, an adhesive consisting of the same polypropylene resin was used.

Figure 2:
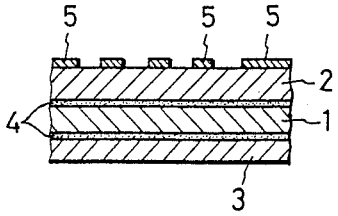

Using the substrate thus obtained, an inductance circuit designed to obtain resonant frequency is printed on the 0.05 mm-thick aluminum foil 2 by a printing process capable of mass production, e.g., gravure printing process, using an ink 5 having etching resistance (see FIG. 2).

Figure 3:
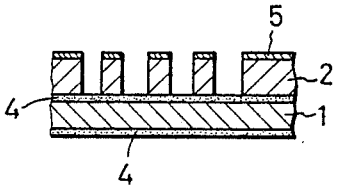
Figure 4:
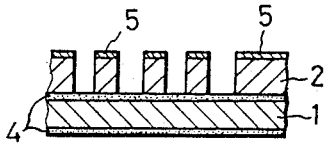

Subsequent to the printing, the aluminum foils 2 and 3 are chemically etched. In this case, in the inductance circuit portions of the aluminum foil without the etching-resist ink 5, i.e., portions free from printing, are perfectly eched away. On the other hand, the aluminum foil 3 with a thickness of 0.006 to 0.010 mm laminated to the side surface of the thin film 1 opposite the 0.05 mm-thick aluminum foil 2 is perfectly etched away. The structure after the etching is shown in FIG. 3.

It may be thought that the aluminum foil 3 with a thickness of 0.006 to 0.010 mm is unnecessary for it is perfectly removed by etching. However, it is necessary for the following two reasons.

The printing of the electric circuit on the aluminum foil 2 is done using an ink which requires drying at a high temperature. Therefore, if the aluminum foil 3 with a thickness of 0.006 to 0.010 mm is not provided, the heat of the high temperature drying acts on the polypropylene film 1 to cause melting thereof or generate wrinkles of the laminated material. The aluminum foil 3 is used to prevent such a trouble. Another reason is that after the etching of the aluminum foil 2 the adhesive 4 remaining on the film surface is utilized to bond the aluminum foil 6 for forming the capacitor electrode. Therefore, the aluminum foil 3 is unnecessary when utilizing a thin film, which is heat-resistant and has satisfactory adhesion.

Subsequently, a capacitor section 21 of the circuit substrate with the electric circuit formed after the etching is formed with a through hole 7 by piercing the capacitor portion 21 from the side of the aluminum foil 2 through the aluminum foil 2, polypropylene film 1 and adhesive layer 4 by using a needle having a diameter of 0.08 to 0.010 mm and a tip diameter of about 0.06 mm. Although a single through hole 7 is sufficient, a plurality of through holes are preferably formed for enhancing the possibility of dielectric breakdown of the dielectric layer. However, if too many through holes are formed, the dielectric tangent value is increased. Therefore not only the performance of the resonant frequency characteristic tag is deteriorated, but also the dielectric breakdown voltage energy is not concentrated, thus leading to the failure of dielectric breakdown. When forming the through hole 7 by using a needle, a tip portion of the electric circuit aluminum foil 2 corresponding to the through hole desirably pierces the dielectric constituted by the polypropylene film 1 and adhesive layer 4 in a burr-like form (see FIG. 5).

Figure 5:
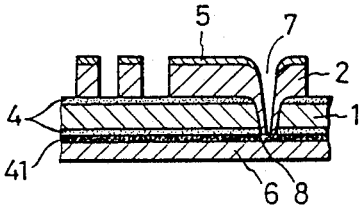

In order to be able to obtain the intended resonant frequency after the through hole 7 has been formed, the electrode aluminum film 6 having a size sufficient for the formation of the capacitor is bonded to the portion surrounding the through hole 7 by using a heated die (see FIG. 5). The aluminum foil 6 which is used at this time has no thickness limitation so long as it has capability of processing and is low in cost.

The adhesive layer 41 for applying the aluminum foil 6 for forming the capacitor is as thin as possible. For instance, the same resin as the dielectric is coated to a thickness of 0.0001 to 0.0003 mm on one side surface of an aluminum foil having a thickness of 0.005 to 0.009 mm. The lamination of the aluminum foil 6 is done only during thermal press bonding of a paper sheet (not shown) having a sufficient mechanical strength as the aluminum foil support to a portion containing the through hole by using a mold. This is done by using a coil-like material laminated with a weak adhesive, which is non-heat-resistant and has a bonding strength of 50 to 100 g/cm$^2$. This material is located such that the through hole is perfectly concealed by the aluminum foil 6 and is press bonded from the paper sheet side by using a heated die having a sufficient size to form the resonant frequency circuit, while at the same time the aluminum foil 6 having the same area as the die is separated. In this case, it is necessary that the bonding strength between the residual adhesive 4 on the side of the circuit substrate and the resin 41 on the side of the aluminum foil 6 press bonded to the residual adhesive 4 is higher than the bonding strength between the bonded aluminum foil 6 and paper sheet. To enable such a processing, an adhesive, which has low heat-resistance and provides a weak bonding strength, is used for the bonding of the paper sheet and aluminum foil 6 to each other.

A capacitor is formed by the burr-like portion 8 of the aluminum foil 2 present at an end of the through hole 7, the press-bonded aluminum foil 6 and the polypropylene resin layer 41 with a thickness of 0.0001 to 0.0003 mm coated on the surface of the aluminum foil 6. More specifically, the aluminum foils 2 and 6 constitute electrodes, and the resin layers 4 and 41 constitute the dielectric. At the time of the thermal press bonding with the die, the resin 41 coated on the press-bonded aluminum foil 6 and adhesive 4 present in the neighborhood of the burr-like portion 8 of the aluminum foil 2 are fused together to form a very thin film. This very thin film functions as a capacitor dielectric. Since the system is pressed at the time of the press bonding, the thickness of the very thin dielectric film intervening between the burr-like portion 8 of the aluminum foil 2 and press-bonded aluminum foil is reduced to 0.0001 to 0.0002 mm. This thickness is sufficient to readily cause the dielectric breakdown.

The processing is performed mechanically with the temperature and pressure controlled automatically. Thus, it is performed very accurately and also continuously.

Figure 6:
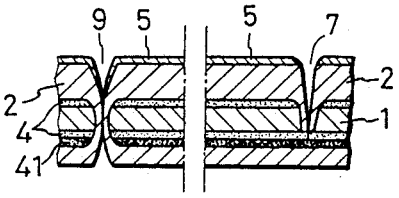
Figure 7:
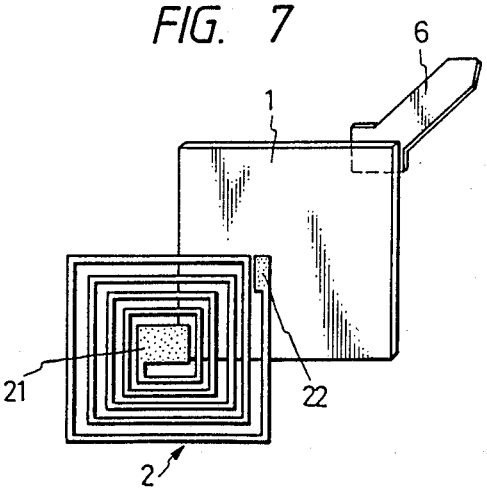
FIG. 7 is an exploded perspective view showing an example of the resonant frequency characteristic tag.

Subsequently, for forming the resonant frequency circuit, the terminal section 22 of the circuit on the side of the aluminum foil 2 formed by etching and serving as resistance and inductance circuit and press-bonded aluminum foil 6 serving as a capacitor electrode are connected to each other as shown in FIG. 6. The connection is suitably effected by a so-called pressure contact process, in which the two aluminum foils 2, 6 are pressed toward each other with a hard member having irregular surfaces so that they contact each other at the pressed portions. By this pressure contact the dielectric intervening between the aluminum foils is ruptured to obtain short-circuit of the opposite side aluminum foils to each other. Reference numeral 9 in FIG. 6 shows a short-circuit position.

With this short-circuit, a resonant frequency circuit consisting of three, i.e., resistive inductive and capacitive, elements is formed to obtain a resonant frequency characteristic tag having a resonant frequency according to the present invention.

Since a very small dielectric film thickness of 0.0001 to 0.0002 mm is used, when the resonant frequency characteristic tag is placed in the high output electric field, it is possible to obtain dielectric breakdown of the dielectric so as to erase the function of the resonant frequency characteristic tag.

A printed or non-printed paper sheet or film is laminated to the capacitor side, i.e., to the press-bonded electrode aluminum foil 6, a release paper sheet or the like is laminated with a pressure sensitive adhesive to the electric circuit side, i.e., the aluminum foil 2, and then the system is stamped out or semi-stamped to the size of the tag with a die. This is the same as the prior art method of use of resonant frequency characteristic tags.

As has been shown, the resonant frequency characteristic tag according to the present invention comprises the burr-like portion of the electric circuit metal foil, electrode metal foil and adhesive layer between these foils, it is possible to obtain a uniform and very thin dielectric layer of the capacitor. The dielectric breakdown of the dielectric thus can be readily caused.

What is claimed is:

1. A resonant frequency characteristic tag comprising:

an electrically insulating thin film having a dielectric characteristic, an electric circuit consisting of a metal foil formed on one side surface of said thin film and having a predetermined length and having opposite end portions respectively formed with a capacitor section and a terminal section, said capacitor section having a piercedly formed hole extending from a side of said metal foil to the other side surface of said thin film, said metal foil being deformed in the formation of said hole into a burr-like portion extending toward said other side surface of said thin film, and an electrode metal foil formed on said other side surface of said thin film and having a size capable of containing said hole, said electrode metal foil being applied to said other side surface of said thin film with an electrically insulating very thin film adhesive having a dielectric characteristic, said adhesive spacing the free end of said burr-like portion and said electrode metal foil apart by a predetermined distance, said terminal section of said electric circuit being electrically connected to said electrode metal foil to form a resonant frequency circuit.

2. The resonant frequency characteristic tag of claim 1 wherein:

said electric circuit is applied to said one side surface of said thin film with an adhesive having a dielectric characteristic.

3. The resonant frequency characteristic tag of claim 1 further comprising:

an inductance circuit printed on the metal foil on said one side surface of said thin film said inductance circuit formed of etch-resistant ink.

* * * * *